US007274892B2

(12) United States Patent
Awaya

(10) Patent No.: US 7,274,892 B2
(45) Date of Patent: Sep. 25, 2007

(54) IMAGE FORMING APPARATUS WITH HEAT EXHAUSTING MEANS FOR EXHAUSTING AIR FROM AROUND A FIXING UNIT AND A DELIVERY TRAY

(75) Inventor: Tetsuro Awaya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/260,402

(22) Filed: Oct. 28, 2005

(65) Prior Publication Data

US 2006/0051123 A1 Mar. 9, 2006

Related U.S. Application Data

(62) Division of application No. 10/499,140, filed as application No. PCT/JP03/01369 on Feb. 10, 2003, now Pat. No. 7,020,411.

(30) Foreign Application Priority Data

Feb. 13, 2002 (JP) ..... 2002-035988

(51) Int. Cl.
*G03G 21/20* (2006.01)

(52) U.S. Cl. ..... 399/92

(58) Field of Classification Search ..... 399/92, 399/91, 93

See application file for complete search history.

(56) References Cited

U.S. PATENT DOCUMENTS

| | | | |
|---|---|---|---|
| 5,164,778 A | 11/1992 | Tanabe et al. | 355/215 |
| 6,308,026 B1 | 10/2001 | Kouchi | 399/110 |
| 2002/0012543 A1 | 1/2002 | Nakamura et al. | 399/69 |

FOREIGN PATENT DOCUMENTS

| | | |
|---|---|---|
| CN | 1331435 | 1/2002 |
| EP | 1 156 399 A3 | 1/2002 |
| JP | 1-316757 | 12/1989 |
| JP | 3-146971 | 6/1991 |
| JP | 5-113708 | 5/1993 |
| JP | 10-228226 | 8/1998 |
| JP | 11-95644 | 4/1999 |
| JP | 2000098860 A * | 4/2000 |
| JP | 2001-42590 | 2/2001 |
| JP | 2001-63890 | 3/2001 |
| JP | 2001-144890 | 5/2001 |
| JP | 2001-236000 | 8/2001 |
| JP | 2001-242769 | 9/2001 |
| JP | 2002-40873 | 2/2002 |

* cited by examiner

*Primary Examiner*—Quana Grainger
(74) *Attorney, Agent, or Firm*—Fitzpatrick, Cella, Harper & Scinto

(57) ABSTRACT

A copying machine 100 is provided with an image forming portion 115 for forming a toner image on a sheet, a fixing device 122 for applying heat to the sheet to fix the toner image on the sheet, a delivery portion 125 on which the sheet is delivered and stacked, heat exhausting fans 157 and 158 provided in the vicinity of the fixing device 122 and the delivery portion 125 for exhausting air in the surroundings of those 122, 125 from the right side 101*b* of the main body 101. There is provided air vents 162, 163 and 164 between the fixing device 122 and the heat exhausting fans 157, 158 and between the delivery portion 125 and the heat exhausting fans 157 and 158. Thus, heat of the fixing device 122 is exhausted to avoid the delivered sheet adhesion caused by the high temperature.

2 Claims, 10 Drawing Sheets

IMAGE FORMING APPARATUS WITH HEAT EXHAUSTING MEANS FOR EXHAUSTING AIR FROM AROUND A FIXING UNIT AND A DELIVERY TRAY

This application is a divisional of U.S. patent application Ser. No. 10/499,140, filed Jun. 18, 2004, now U.S. Pat. No. 7,020,411.

TECHNICAL FIELD

The present invention relates to an image forming apparatus, such as a copying machine or a laser beam printer etc., for forming a toner image on a sheet.

BACKGROUND ART

There are conventional image forming apparatus, such as copying machines or laser beam printers (LBP), which form images on sheets.

In FIG. 8, a copying machine as an example of such an image forming apparatus is shown. The copying machine 10 is provided with a document stand 2 composed of a transparent glass plate that is fixed to the top portion of the main body 1 of the copying machine 10. A document pressure cover 3 is configured to press a document D that is being placed at a predetermined position on the document stand 2 with its image surface facing downward, against the document stand 2 to immobilize it. Beneath the document stand 2, there is provided an optical system composed of a lamp 4 for illuminating the document D, reflection mirrors 5, 6 and 7 for directing a reflected light image of the document D to an image processing unit 8 and an imaging lens 11. The lamp 4 and the reflection mirrors 5, 6 and 7 are adapted to be moved in the direction indicated by arrow a at a predetermined speed so as to scan the document D.

An image forming portion 15 includes a photosensitive drum 12, a charger 13 for charging the surface of the photosensitive drum 12 uniformly, a developing device 14 for forming a toner image on the photosensitive drum 12, a transferring charger 19 for transferring the toner image formed on the photosensitive drum 12 onto a sheet S, a stripping charger 20 for stripping the sheet S, on which the toner image has been transferred, from the photosensitive drum 12, and a cleaner 26 for removing toner remaining on the photosensitive drum 12 after the toner image has been transferred. The photosensitive drum 12 is adapted in such a way that an electrostatic latent image is formed, by a light image radiated by a laser unit 9, on the surface of the photosensitive drum 12 that has been charged by the charger 13 and then the electrostatic latent image is developed and transferred onto the sheet S. The sheet S is fed from a sheet cassette 27.

In the downstream of the image forming portion 15, there is provided in sequence, a transport portion 21 for transporting the sheet S on which the toner image has been transferred, a fixing device 22 for fixing the toner image on the sheet S transported by the transport portion 21 to the sheet as a permanent image, and a delivery roller pair 24 for delivering the sheet S on which the toner image has been fixed by the fixing device 22, from the main body 1 of the copying machine. The copying machine has a delivery portion 25 provided externally of its main body 1 for receiving the sheet S delivered by the delivery rollers 24.

There is another type of copying machine such as a copying machine 16 shown in FIG. 9 that has an in-body delivery structure in which sheets are delivered inside its main body in order to save space. The image forming process of this copying machine 16 is substantially the same as that of the copying machine 10 shown in FIG. 8, though a sheet transport path 53 of the transfer portion is configured to guide sheets S in the vertical direction. In addition, a transfer roller 50 is used in place of the transfer charger 19 shown in FIG. 8. In the copying machine 16 shown in FIG. 9, the sheet transport path 53 is provided in the right side portion of the main body 1 of the apparatus. Therefore, a fan 54 is provided on the side of the left side wall of the main body 1 of the apparatus so as to cause air in the main body of the machine to flow from the right to the left of the main body 1 of the apparatus.

There is also another type of copying machine 28 shown in FIG. 10, which is additionally provided with a rotary developing unit 51 and an intermediate transfer belt 52 etc. for forming a color image. This copying machine 28 uses a charging roller 60 in place of the charger 13 shown in FIG. 8.

The fixing device 22 of each of the copying machines 10, 16 and 28 is adapted to nip and transport the sheet while applying heat and pressure to it so as to fix the toner image on the sheet.

In connection with the above descriptions, components of the copying machines 16 and 28 that operate in the same manner as the corresponding components of the copying machine 10 are designated with the same reference signs as the components of the copying machine 10, and the descriptions of those components are omitted.

In the structure like that shown in FIG. 10, in which a fan 55 is provided on the side of the left side wall of the main body 1 of the apparatus to cause air to flow from the right to the left of the main body 1 of the apparatus, there is a risk that the heat generated by the fixing device 22 might be transferred to the rotary developing unit 51 and the intermediate transfer belt 52 etc. The rotary developing unit 51 and the intermediate transfer belt 52 are processing units that use toner, and therefore if their temperatures increase excessively, troubles such as toner blocking or fusion bonding of toner can occur.

In the copying machines 16 and 28 shown in FIGS. 9 and 10, in which sheets are transported vertically along the sheet transport path 53, the distance between the fixing device 22 that fixes toner images on sheets and the delivery portion 25 that delivers the sheets is relatively small as compared to the copying machine 10 shown in FIG. 8, in which sheets are transported horizontally. Therefore, the temperature of the sheets delivered to the delivery portion 25 is high, and so sheets can stick or adhere to each other due to toner images that have not been cooled sufficiently (such phenomena will be referred to as "delivered sheet adhesion" hereinafter).

In addition, the fan 56 of the copying machine 10 shown in FIG. 8 is disposed in the rear side portion of the main body 1 of the apparatus and in the vicinity 61 of the fixing device 22. The fan 54 of the copying machine 16 shown in FIG. 9 is disposed in the vicinity 62 of the left side wall of the main body 1 of the apparatus. The fan 57 of the copying machine 28 shown in FIG. 10 is disposed in the rear side portion of the main body 1 of the apparatus and in the vicinity 63 of the fixing device 22. Therefore, when the fans 56, 54 and 55 are to be replaced due to any trouble, a service person is required to approach to the left side wall or the rear side of the main body 1 of the apparatus for replacement operations. In addition, the above-described arrangements of the fans not only require a long time for maintenance operations but also require the copying machine to be shut down for a long time (i.e. downtime is long).

Furthermore, in the copying machine 16 shown in FIG. 9, in which sheets S are transported vertically along the sheet transport path 53, the leading edges of the sheets may bend to the right or left, and therefore they are often transported under unstable states. Especially, after a sheet has left the fixing device 22 and until it reaches the delivery portion 25, the sheet is apt to be curled due to heat and pressure applied by the fixing device 22, and so it is required to enable stable transportation of the sheets.

Since the fan 57 of the copying machine 28 shown in FIG. 10 is disposed in the rear side portion of the main body 1 of the apparatus and the fixing device 22 is arranged longitudinally in the direction transverse to the direction of the sheet transportation (i.e. the longitudinal direction coincides with the direction perpendicular to the plane of the drawing sheet of FIG. 10), the heat of the fixing device 22 is exhausted at one end of the fixing device 22, and therefore the efficiency of heat exhaust is low.

DISCLOSURE OF THE INVENTION

An object of the present invention is to provide an image forming apparatus that can exhaust the heat generated by fixing means that generates heat to prevent the delivered sheet adhesion due to high temperature from occurring.

An image forming apparatus with heat exhausting means that attains the above object comprises:

image forming means for forming a toner image on a sheet;

fixing means for applying heat to the sheet on which the toner image has been formed by the image forming means so as to fix the toner image on the sheet;

delivering and stacking means on which the sheet, on which the toner image has been fixed by the fixing means, is to be delivered and stacked; and heat exhausting means provided in the vicinity of the fixing means and the delivering and stacking means, for exhausting air in the surroundings of the fixing means and air in the surroundings of the delivering and stacking means from a side portion of a main body of the apparatus, wherein air vents are provided between the fixing means and the heat exhausting means and between the delivering and stacking means and the heat exhausting means, respectively.

In the image forming apparatus with heat exhausting means according to the invention, the delivering and stacking means may be disposed above the fixing means, and the image forming apparatus may further comprise a sheet transport path arranged in a vertical direction between the fixing means and the delivering and stacking means, the sheet transport path having an air vent.

The image forming apparatus with heat exhausting means according to the present invention may further comprise heat exhaust control means for controlling, while the sheet is transported in the sheet transport path, the heat exhausting means in such a way as to reduce an air exhaust amount of the heat exhausting means as the sheet approaches from the fixing means to the delivering and stacking means.

In the image forming apparatus with heat exhausting means according to the present invention, the heat exhausting means may be disposed on a lid that is provided on a side portion of the main body of the apparatus.

In the image forming apparatus with heat exhausting means according to the present invention, the lid may be provided in such a way that the lid is openable and closable with a pivot being located at the rear side of the side portion of the main body of the apparatus.

These and other objects, features and advantages of the present invention will become more apparent upon consideration of the following description of the preferred embodiments of the invention taken in conjunction with the accompanying drawings.

BEST MODE FOR CARRYING OUT THE INVENTION

In the following, the present invention will be described with reference to the drawings in connection with image forming apparatus in the form of copying machines as embodiments of the present invention. The image forming apparatus according to the present invention has a unit, e.g. a fixing device that generates heat in the interior of the main body of the apparatus. Such image forming apparatus includes a printer and other apparatus, besides a copying machine. Therefore, the image forming apparatus according to the present invention is not limited to a copying machine.

COPYING MACHINE ACCORDING TO FIRST EMBODIMENT

Figure 1:
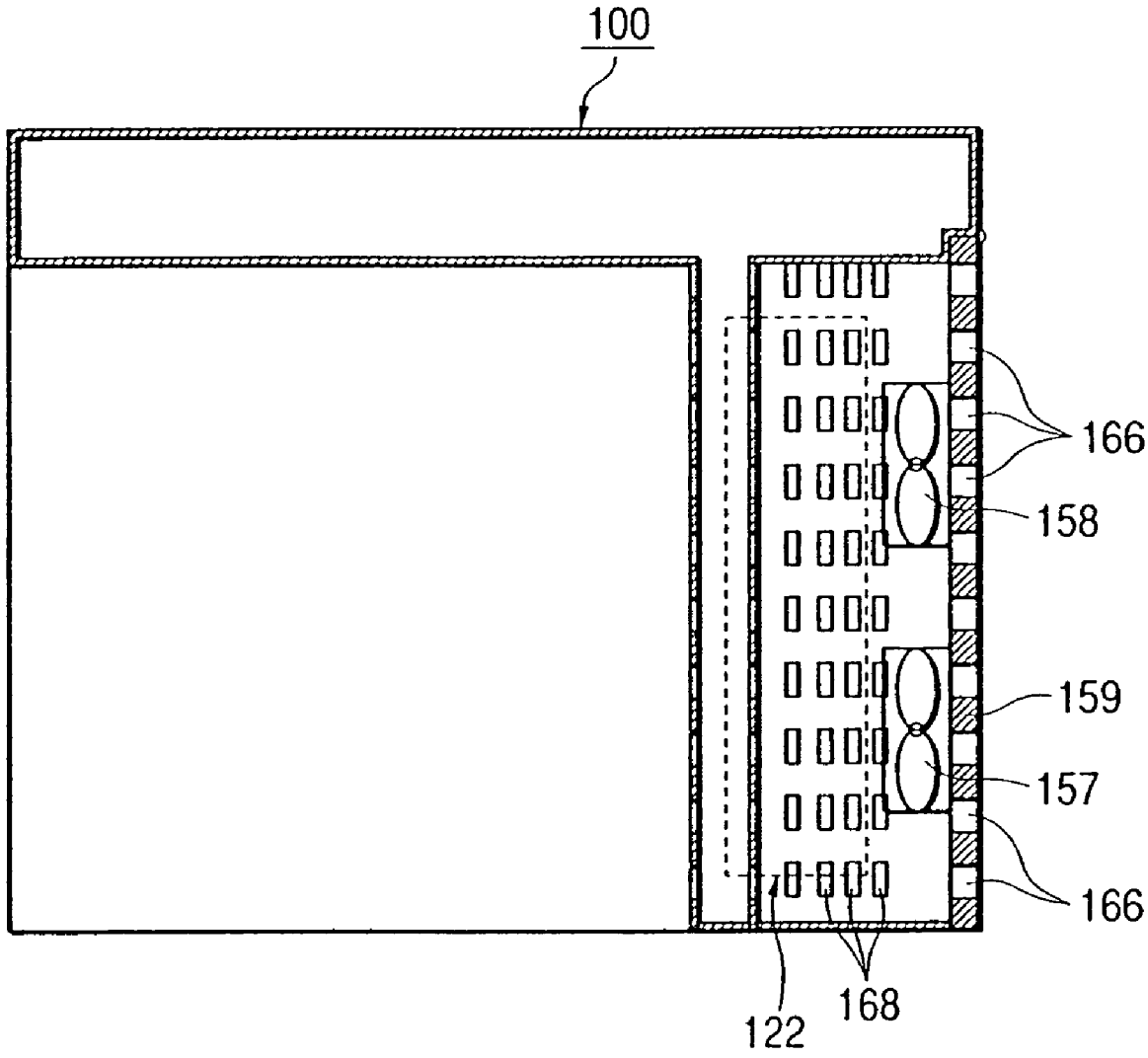
FIG. 1 is a plan view showing an intermediate portion with respect to the height direction of a copying machine as an image forming apparatus according to the first embodiment of the present invention.
Figure 2:
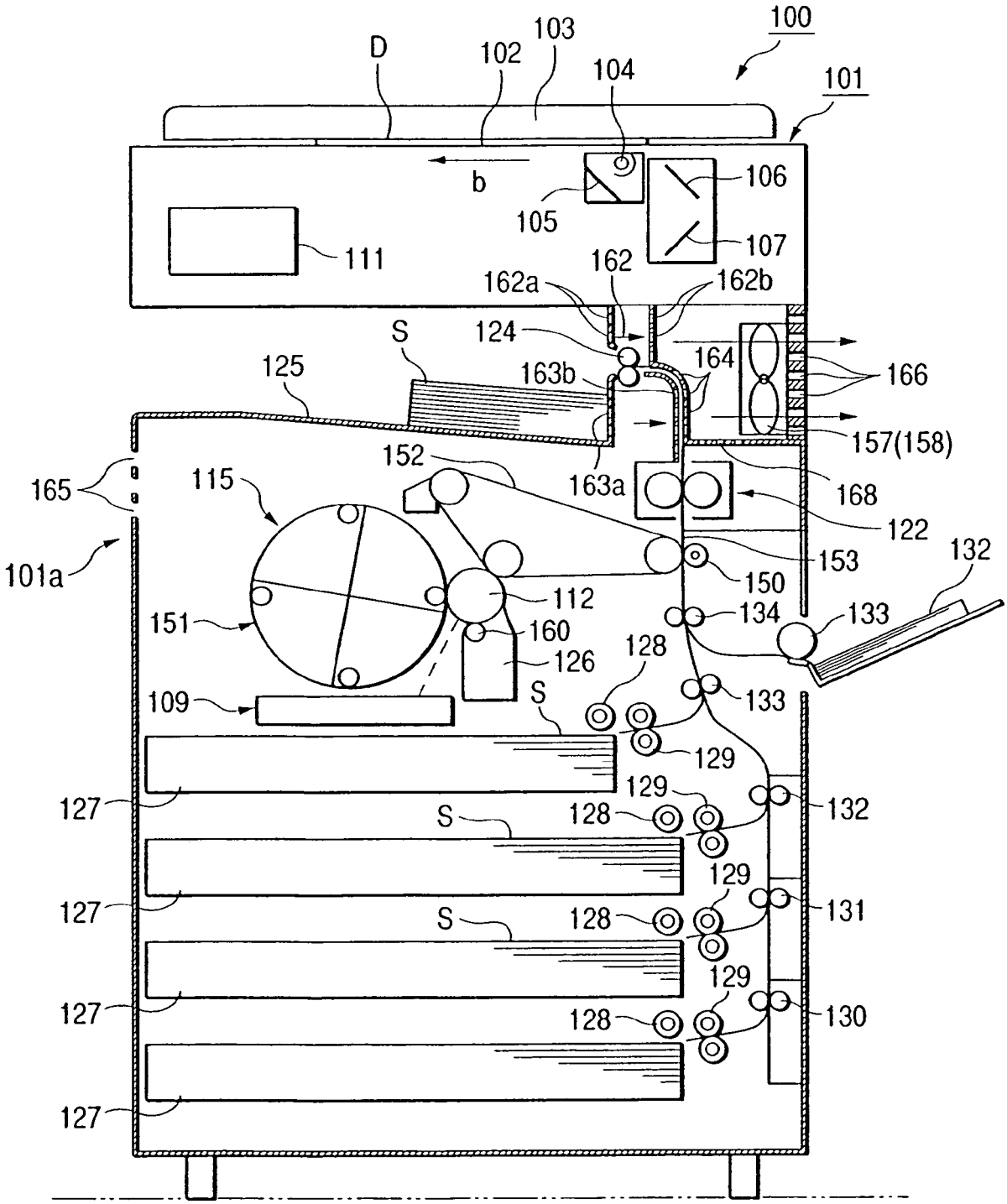
FIG. 2 is a cross sectional front view showing the copying machine as the image forming apparatus according to the first embodiment of the present invention.
Figure 3:
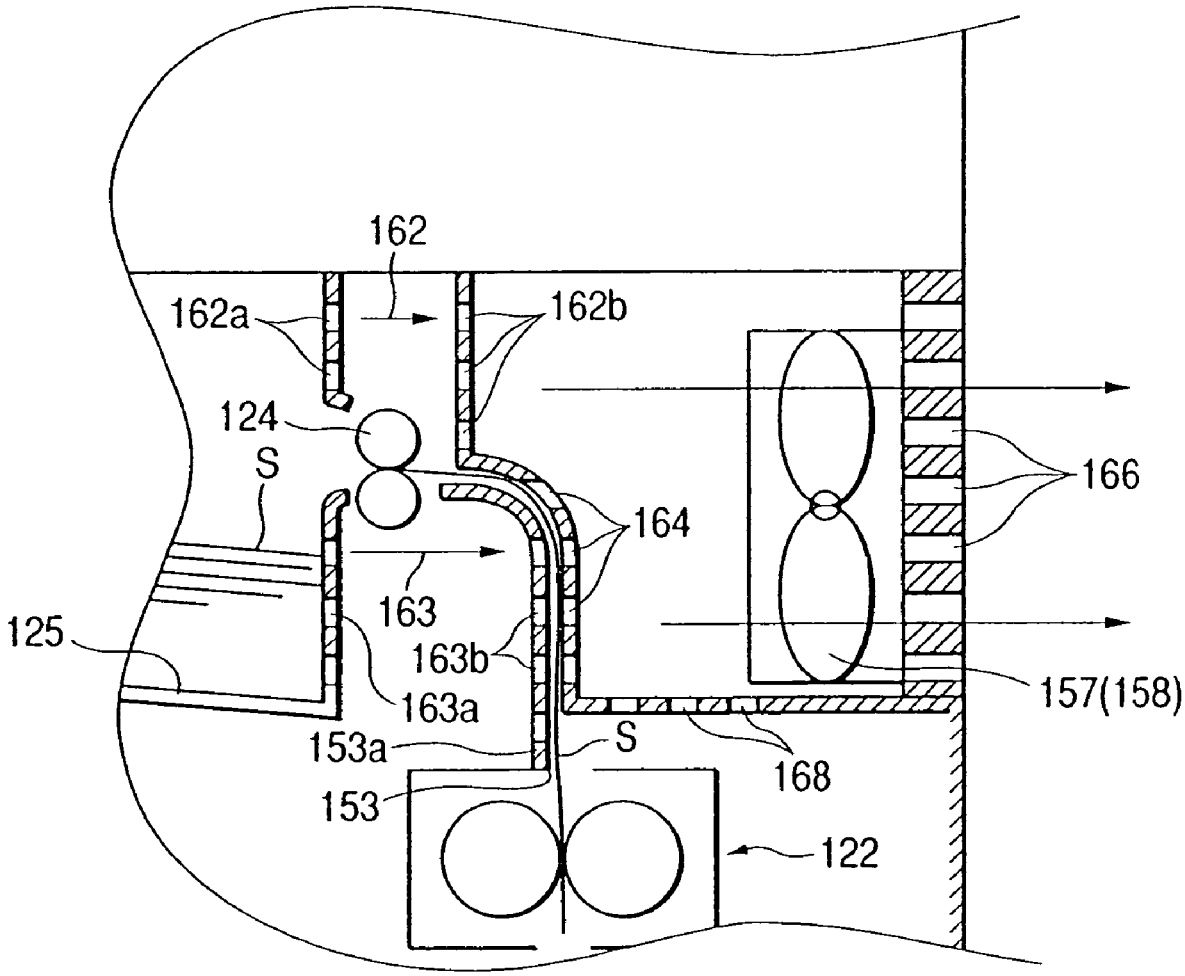
FIG. 3 is a cross sectional view showing a portion including heat exhausting fans of the copying machine as the image forming apparatus according to the first embodiment of the present invention.

In the following, a copying machine according to a first embodiment of the invention will be described with reference to FIGS. 1, 2 and 3. FIG. 1 is a plan view of the copying machine. FIG. 2 is a cross sectional front view of the copying machine. FIG. 3 is a detailed view showing a portion around a fixing device 122 and a delivery portion 125.

As shown in FIG. 2, the copying machine 100 is provided with a document stand 102 composed of a transparent glass plate that is fixed to the top portion of the main body 101 of the machine. A document pressure cover 103 is configured to press a document D that is being placed in a predetermined position on the document stand 102 with its image surface facing downward, against the document stand 102 to immobilize it. Beneath the document stand 102, there is provided an optical system composed of a lamp 104 for illuminating the document D, reflection mirrors 105, 106 and 107 for directing a reflected light image of the document D to an image processing unit, and an imaging lens 111. The lamp 104 and the reflection mirrors 105, 106 and 107 are adapted to be moved in the direction indicated by arrow b at a predetermined speed so as to scan the document D.

An image forming portion 115 includes a photosensitive drum 112, a charging roller 160 for charging the surface of the photosensitive drum 112 uniformly, a rotary developing unit 151 for forming a toner image on the photosensitive drum 112, an intermediate transfer belt 152 onto which the toner image having been developed on the photosensitive drum 112 is transferred, a transfer roller 150 for transferring the toner image on the intermediate transfer belt 152 onto a sheet S, and a cleaner 126 for removing toner remaining on the photosensitive drum 112 after the transfer of the toner image. The photosensitive drum 112 is adapted in such a way that an electrostatic latent image is formed, by a light image radiated by a laser unit 109, on the surface of the photosensitive drum 112 that has been charged by the charging roller 160 and then the electrostatic latent image is developed and transferred onto the intermediate transfer belt 152. The toner image on the intermediate transfer belt 152 is transferred by the transfer roller 150 onto the sheet S. The sheet S is passed out from a sheet cassette 127 by a pickup roller 128 and fed by a retard roller pair 129 that separates and feeds only one sheet, and the sheet S is further transported by transport roller pairs 130, 131, 132, 133, 134 to the position in which the transfer is performed.

Above the image forming portion 115 and in the downstream of it in the transport direction, there is provided in sequence, a fixing device 122 for fixing the toner image on the sheet S that is being transported as a permanent image and a delivery roller pair 124, disposed above the fixing device 122, for delivering the sheet S on which the toner image has been fixed by the fixing device 122, from the main body 101 of the copying machine. The copying machine 100 has a delivery portion 125 provided externally of its main body 101 to receive the sheet S delivered by the delivery roller pair 124.

As shown in FIG. 3, heat exhausting fans 157 and 158 are provided on a jammed sheet clearance door 159 in the right side portion 101*b* of the housing of the main body 101 of the copying machine 100. The jammed sheet clearance door 159 has a plurality of exhaust openings 166 formed at the portion on which the heat exhausting fans 157 and 158 are mounted. In the left side portion (or wall) of the housing of the main body 101 opposed to the heat exhausting fans 157 and 158 and in a wall 153*a* of a sheet transport path 153, and in the vicinity of the fixing device 122, there is provided a plurality of air vents 162*a*, 162*b*, 163*a*, 163*b*, 164 and 168 through which air passes. In addition, as shown in FIG. 2, a plurality of intake openings 165 are formed in the left side portion 101*a* of the main body, which allow air to flow into the main body 101 from the exterior thereof.

When the heat exhausting fans 157 and 158 rotate, ambient air flows into the main body 101 of the copying machine 100 through the intake openings 165 (see FIG. 2) and passes through the air vents 168, and then the air is exhausted from the exhaust openings 166. During this process, air in the surroundings of the image forming portion 115 and air in the surroundings of the fixing device 122 are also exhausted together with the ambient air.

The fixing device 122 is disposed longitudinally in a direction transverse to the direction of sheet transportation. In other words, the fixing device 122 is disposed longitudinally in the direction perpendicular to the plane of the drawing sheets of FIGS. 2 and 3. The heat exhausting fans 157 and 158 are arranged above and laterally offset from the fixing device 122 along the longitudinal direction of the fixing device 122. By virtue of such an arrangement, it is ensured that the heat of the fixing device 122 can be exhausted to the exterior of the main body 1 of the apparatus and the fixing device 122 can be cooled.

On the other hand, the ambient air also forms airflows 162 and 163 passing through the air vents 162*a*, 162*b*, 163*a*, 163*b* and 164, which are exhausted from the exhaust openings 166 and 167. Therefore, the ambient air heated by the sheets S and stagnating at the delivery portion 125 is also exhausted from the exhaust openings 166 via air vents 162*a*, 162*b*, 163*a*, 163*b* and 164. Therefore, the delivery portion 125, the sheets S stacked on the delivery portion 125, the fixing device 122 and the sheet transport path 153 disposed downstream of the fixing device 122 are cooled.

It should be noted that the number of heat exhausting fans is not limited to two, but it may be one or more than two. In the case in which the number of the heat exhausting fan is one, it is preferable that the heat exhausting fan be disposed in such a way as to be opposed to the mid-portion in the longitudinal direction of the fixing device 122.

The heat exhausting fan(s) is not necessarily required to be provided on the jammed sheet clearance door 159, but the heat exhausting fan(s) may be provided on the main body 101 of the apparatus.

As per the above, since the copying machine 100 according to the first embodiment is so configured that the air in the vicinity of the fixing device 122, which is a source of heat, is exhausted immediately by the heat exhausting fans 157 and 158, air heated by fixing device 122 is rarely transferred to other processing units such as the rotary developing unit 151 and the intermediate transfer belt 152 etc. Therefore, efficient heat exhausting is made possible and it is possible to prevent troubles such as toner blocking or fusion bond of toner from occurring.

Furthermore, the copying machine 100 according to the first embodiment is configured to also exhaust the air in the space between the fixing device 122 and the delivery portion 125, so that the sheets S are cooled. Therefore, it is possible to reduce the temperature of the sheets S in the delivery portion 125 so as to prevent delivered sheet adhesion from occurring.

COPYING MACHINE ACCORDING TO SECOND EMBODIMENT

Figure 4:
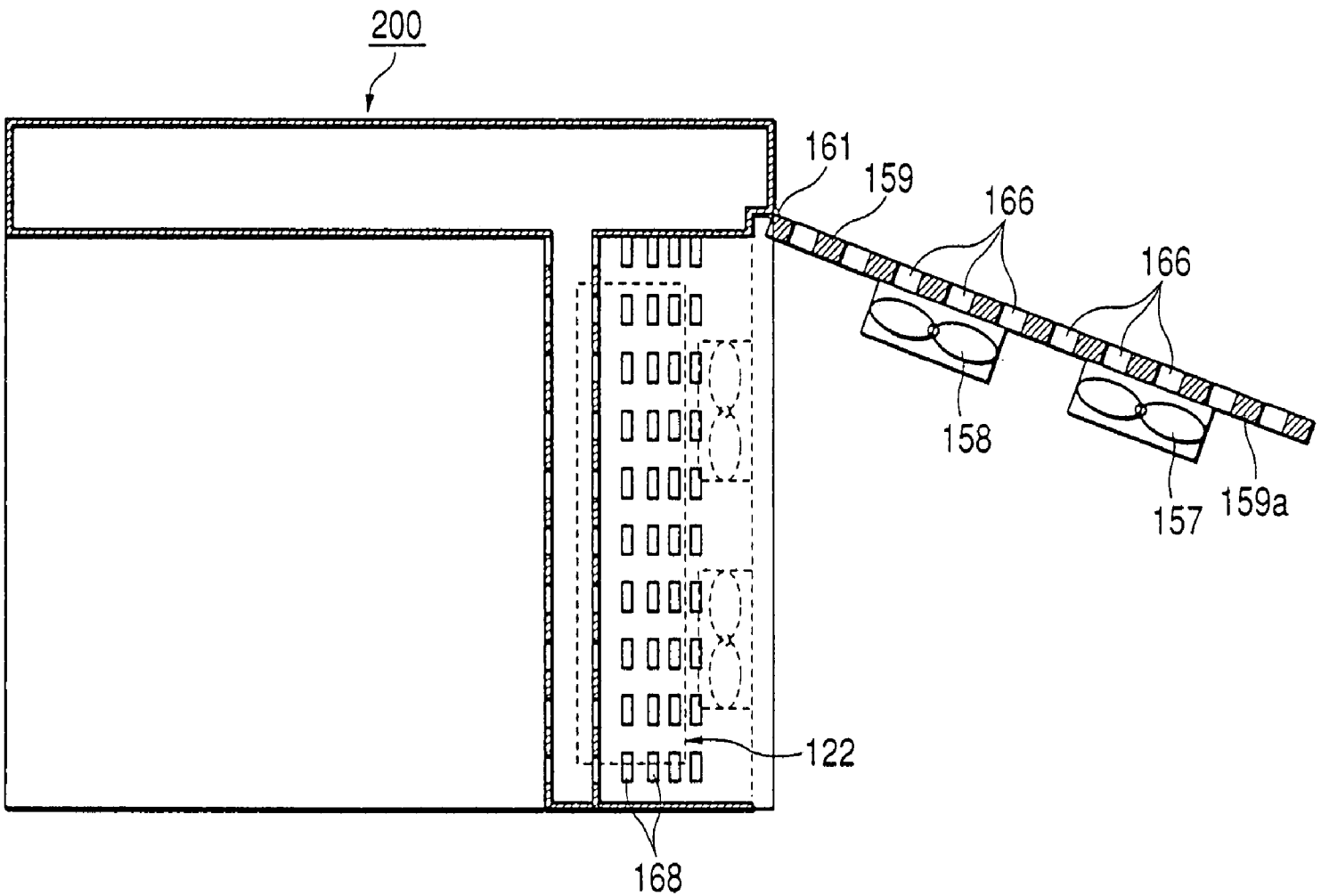
FIG. 4 is a plan view showing an intermediate portion in the height direction of a copying machine as an image forming apparatus according to the second embodiment of the present invention.
Figure 5:
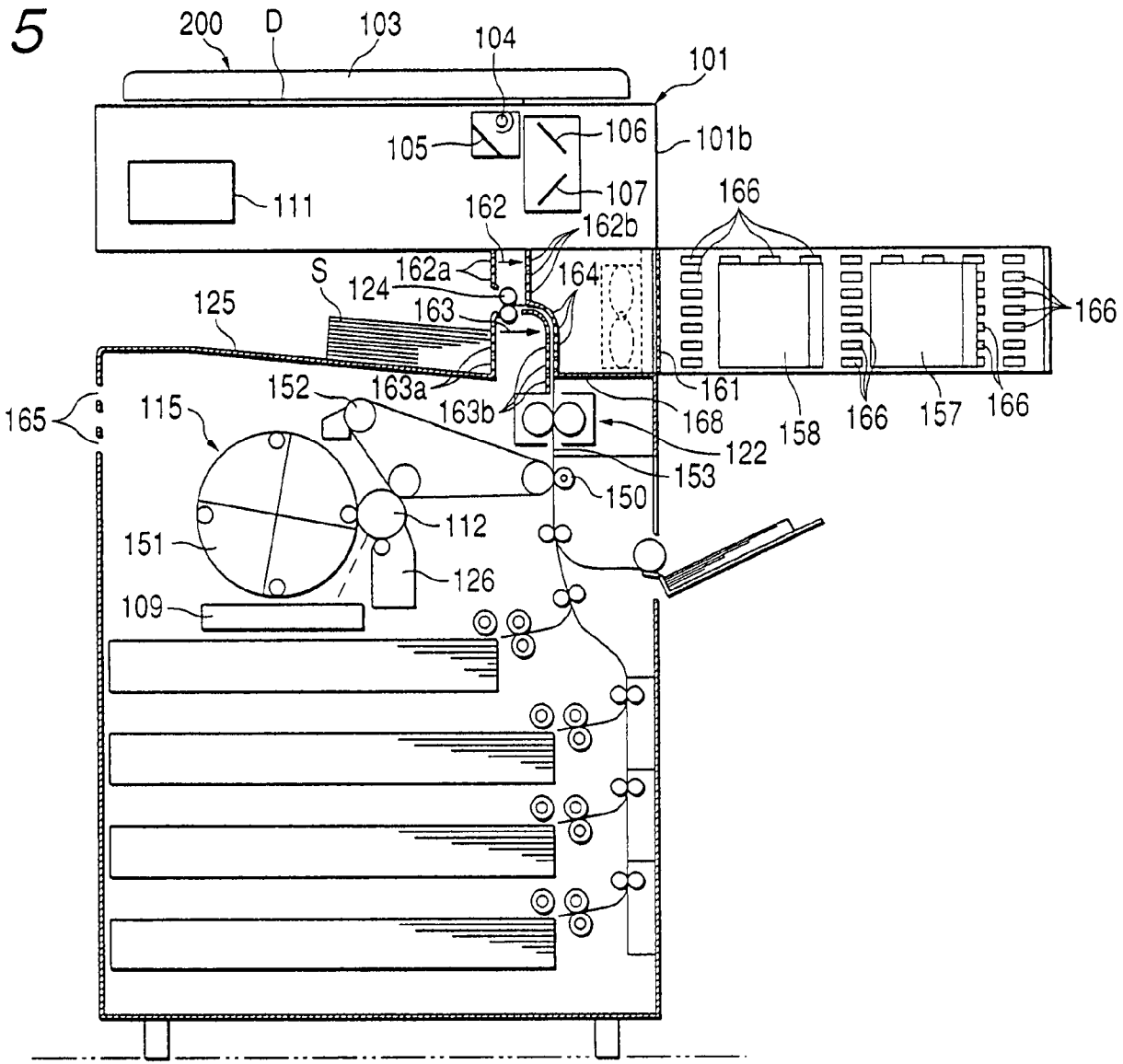
FIG. 5 is a cross sectional front view showing the copying machine as the image forming apparatus according to the second embodiment of the present invention.

In the following, a copying machine according to a second embodiment of the invention will be described with reference to FIGS. 4 and 5. FIG. 4 is a plan view of the copying machine and FIG. 5 is a cross sectional front view of the copying machine.

The copying machine 200 according to the second embodiment differs from the copying machine 100 according to the first embodiment in that a jammed sheet clearance door 159 is provided on the main body 101 of the apparatus in such a way that it is openable and closable and heat exhaust fans 157 and 158 are provided on that jammed sheet clearance door 159. In the copying machine 200 according to the second embodiment, the same parts as those in the copying machine 100 according to the first embodiment are designated with the same reference signs and the descriptions thereof will be omitted.

The heat exhausting fans 157 and 158 are provided on the inner surface 159*a* of the jammed sheet clearance door 159 that is provided at the right side wall of the copying machine 200. The hinge portion 161 of the jammed sheet clearance door 159 is disposed on the rear side of the copying machine to support the jammed sheet clearance door 159 so that the jammed sheet clearance door 159 is pivotable with respect to the main body 101 of the apparatus.

Upon replacing the heat exhausting fans 157 and 158 for any trouble or upon performing maintenance of the heat exhausting fans 157 and 158, a service person will open the jammed sheet clearance door 159 by swinging it with the hinge portion 161 being the pivot. Then, the service person can perform the replacement of the heat exhausting fans 157 and 158 or other maintenance operations from the front side of the copying machine 200, and therefore the time required for the replacement operation of the heat exhausting fans 157 and 158 or the time required for the maintenance operations can be reduced. In addition, since the heat exhausting fans 157 and 158 are supported by the jammed sheet clearance door 159, the maintenance operations can be performed very easily. Furthermore, since the down time of the copying machine 200 can also be reduced, it is possible to enhance the utilization efficiency of the copying machine 200.

In addition to the above, the copying machine 200 according to the second embodiment has the same features as those of the copying machine 100 according to the first embodiment.

In this copying machine 200 according to the second embodiment also, the number of heat exhausting fans is not limited to two, but it may be one or more than two. In the case in which the number of the heat exhausting fan is one, it is preferable that the heat exhausting fan be disposed in such a way as to be opposed to the mid-position in the longitudinal direction of the fixing device 122.

COPYING MACHINE ACCORDING TO THIRD EMBODIMENT

Figure 6:
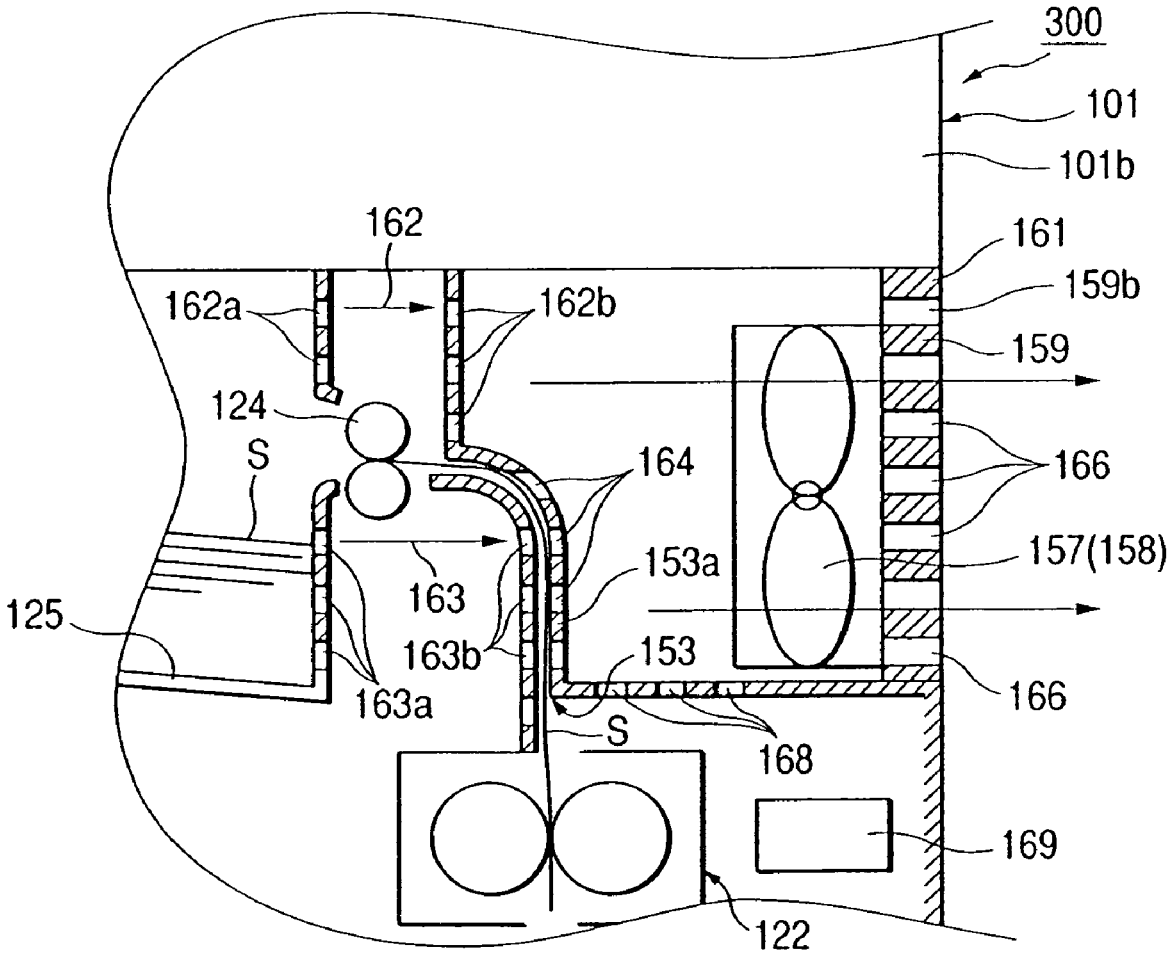
FIG. 6 is a cross sectional view showing a portion including heat exhausting fans of a copying machine as an image forming apparatus according to the third embodiment of the present invention.
Figure 7:
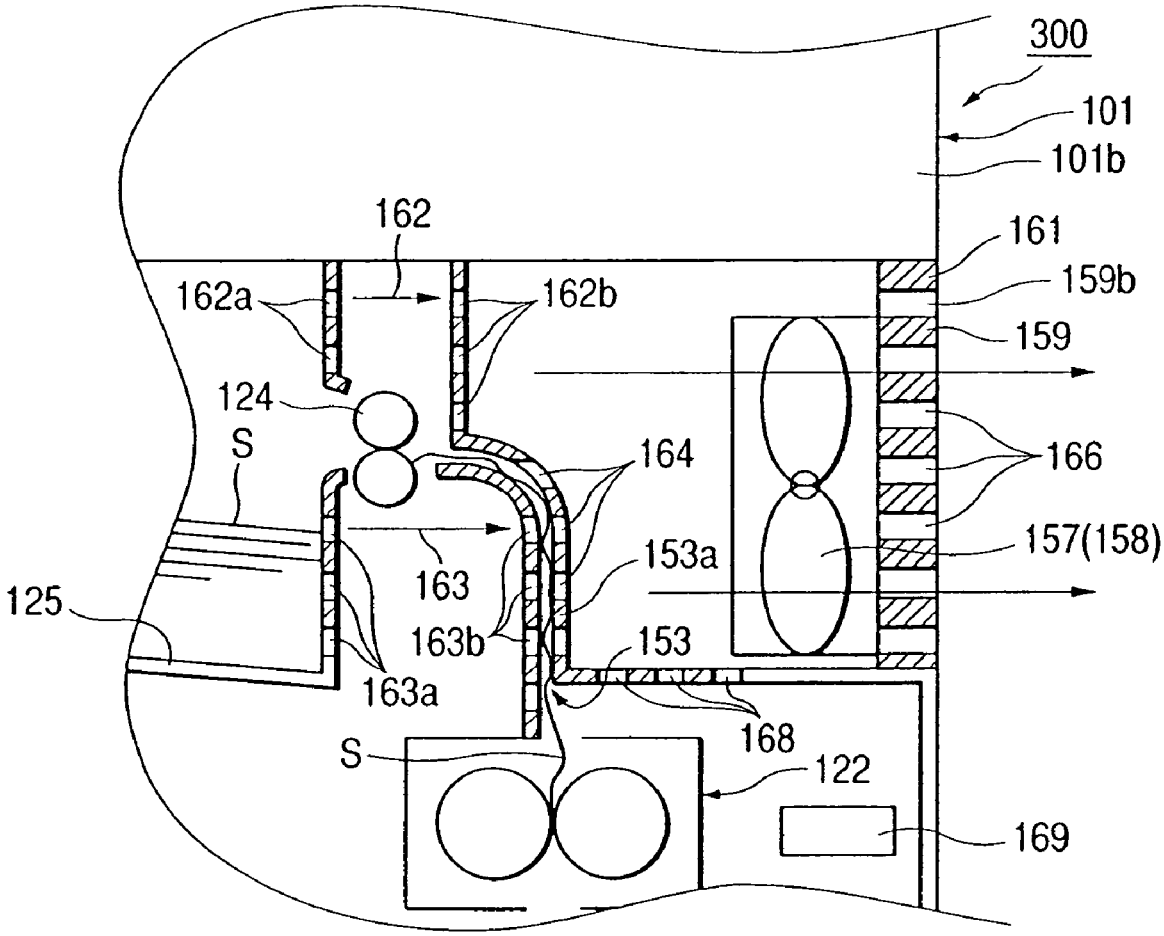
FIG. 7 is a cross sectional view of the portion shown in FIG. 6, showing a state in which a sheet is wrinkled.
Figure 8:
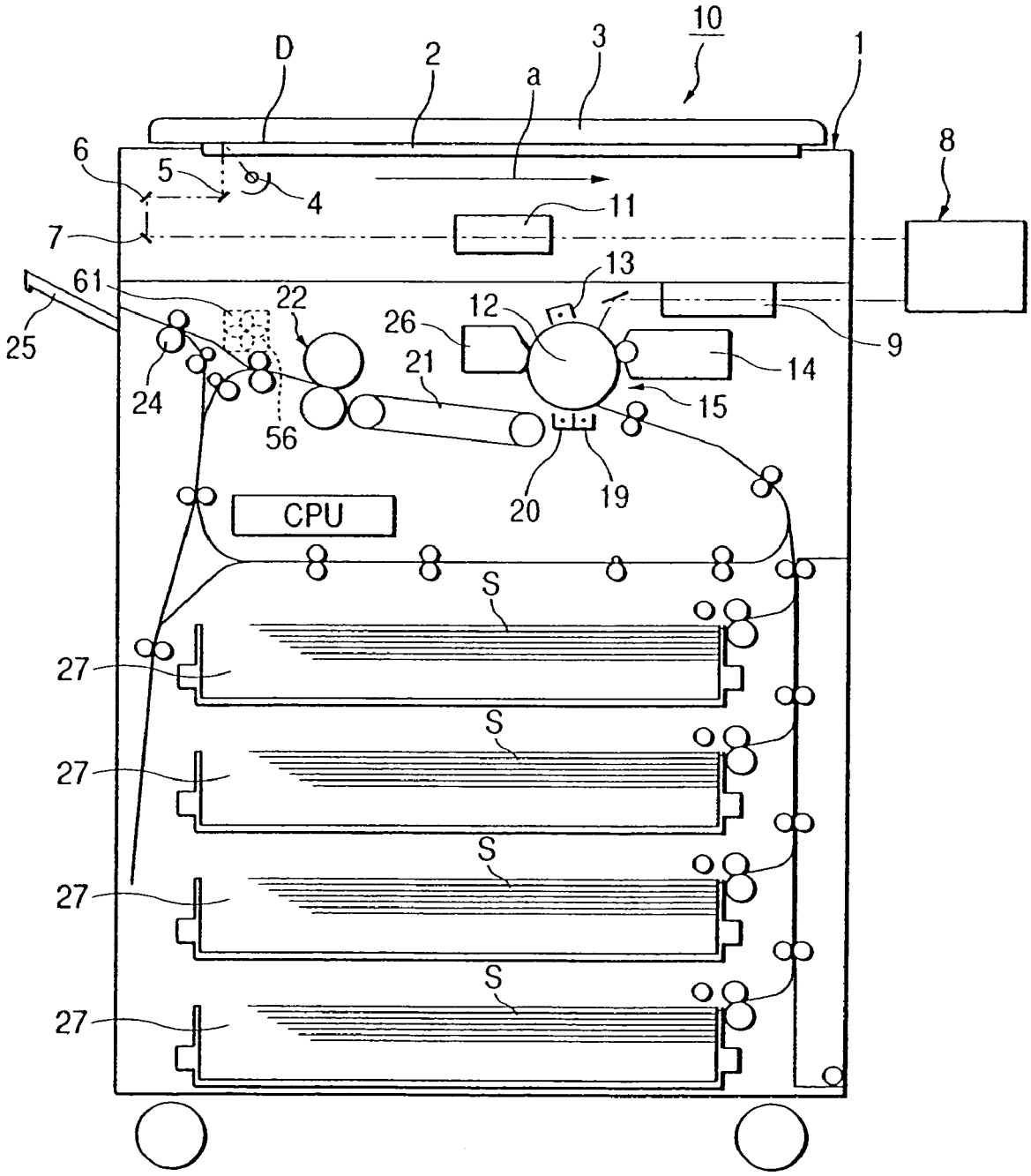
FIG. 8 PRIOR ART
FIG. 8 is a cross sectional front view showing a copying machine as a conventional image forming apparatus.
Figure 9:
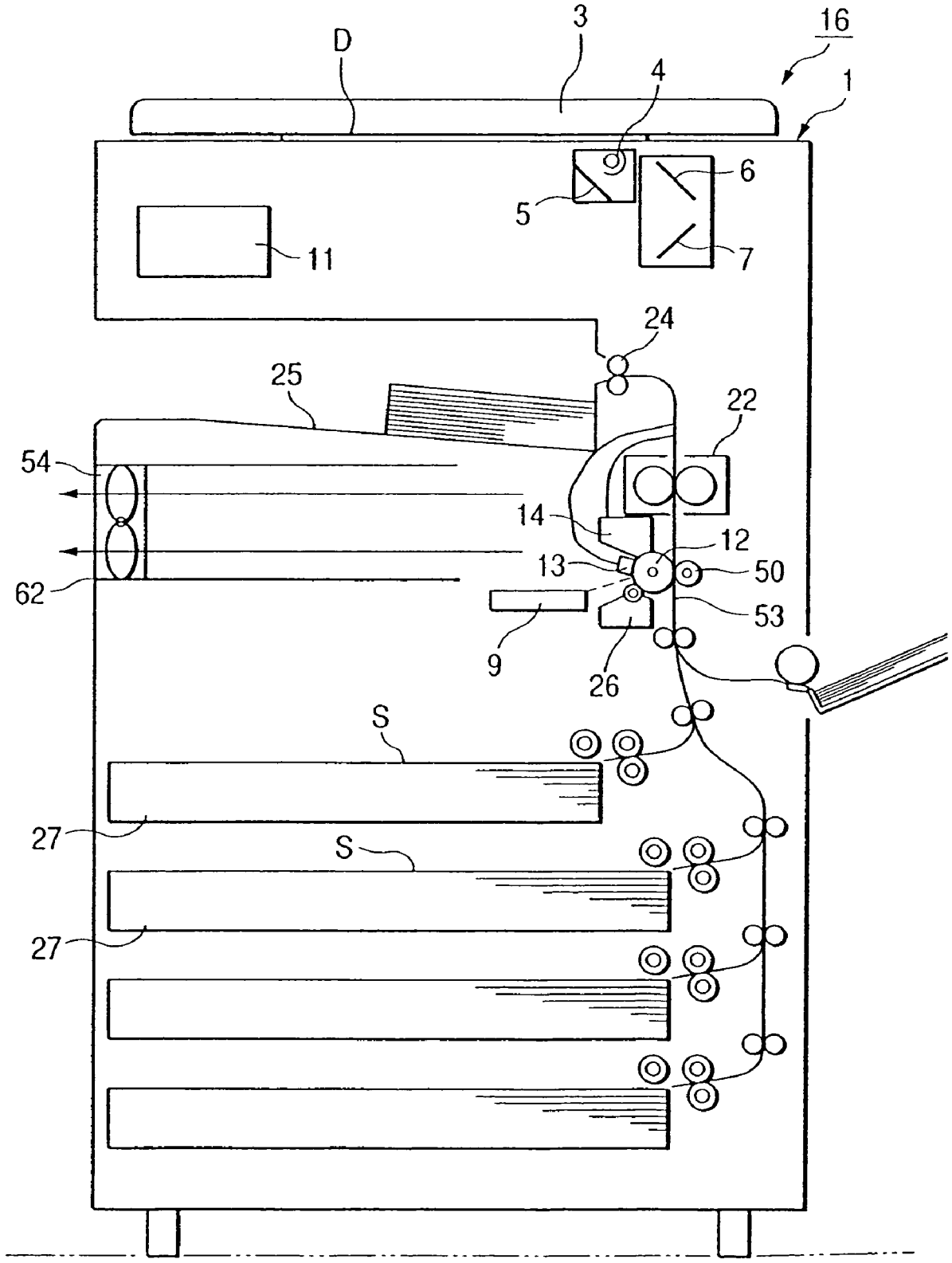
FIG. 9 PRIOR ART
FIG. 9 is a cross sectional front view showing a copying machine as a conventional image forming apparatus.
Figure 10:
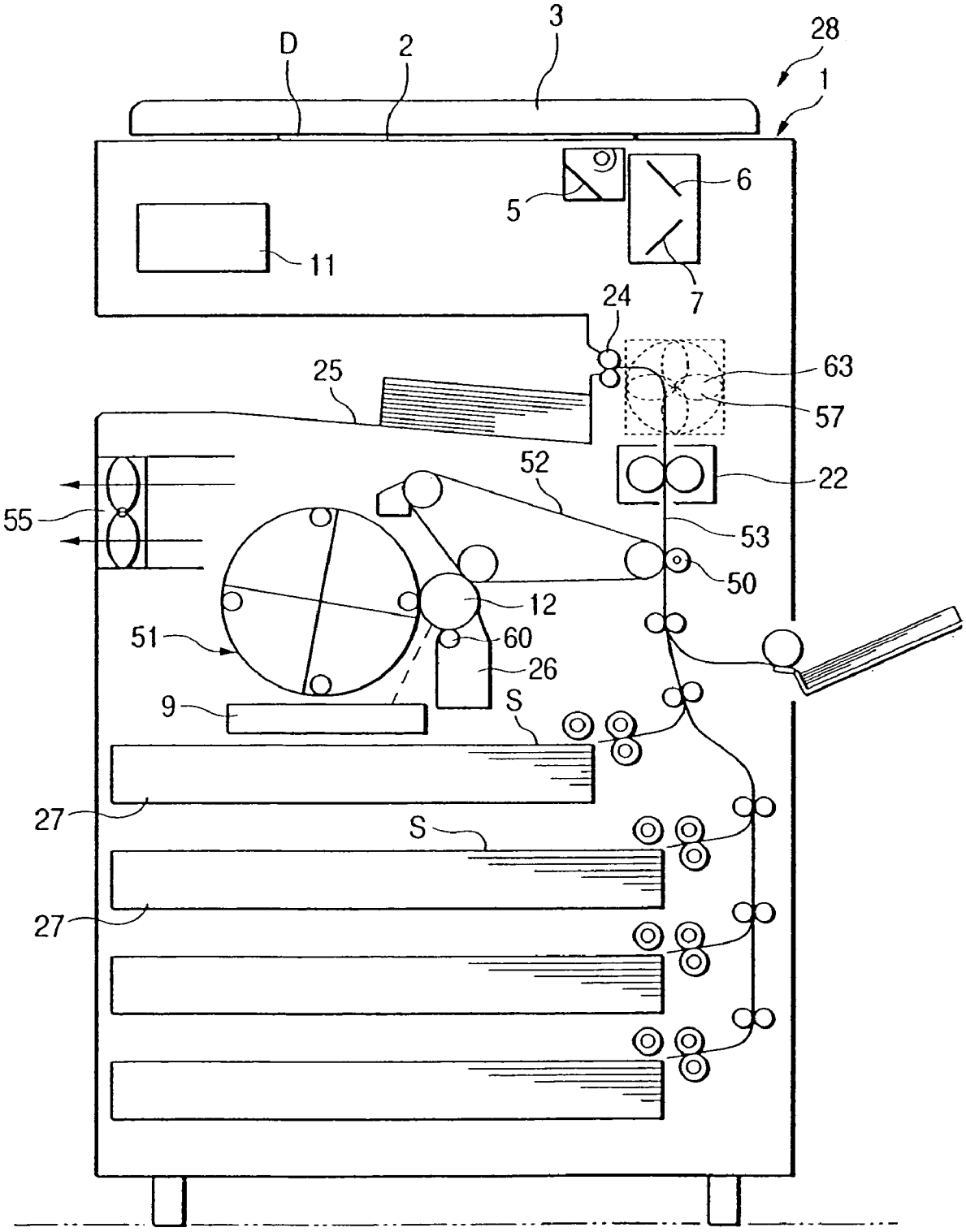
FIG. 10 PRIOR ART
FIG. 10 is a cross sectional front view showing a copying machine as a conventional image forming apparatus.

In the following, a copying machine according to a third embodiment of the invention will be described with reference to FIGS. 6 and 7. FIGS. 6 and 7 are cross sectional views showing a portion including heat exhausting fans of the copying machine 300 according to the third embodiment. In the copying machine 300 according to the third embodiment, the same parts as those in the copying machine 100 according to the first embodiment are designated with the same reference signs and the descriptions thereof will be omitted.

In the copying machine 300 according to the third embodiment, heat exhausting fans 157 and 158 are so controlled by a heat exhaust control portion 169 that their rotating speed can be varied in accordance with transport timing of sheets.

As the copying machine 300 performs an image forming operation, the heat exhausting fans 157 and 158 exhaust air in the surroundings of the fixing device 122 and the delivery portion 125 in the right direction of the main body 101 of the copying machine. On that occasion, since air flows from the air vents 164 in the wall 153*a* of the sheet transport path 153 toward the outer surface 159*b* of the jammed sheet clearance door 159, it is possible to cause the sheet S to travel along the wall 153*a* of the sheet transport path 153 as shown in FIG. 6.

However, depending on the size or material of a sheet, there is a risk that the sheet can be sucked to the wall 153*a* and transport might be stopped, or the sheet can be flexed with the aid of its gravity as shown in FIG. 7 and its smooth transportation might be disturbed.

In order to prevent the above risk, when a sheet passes through the suction area on the way from the fixing device 122 to the delivery portion 125, the heat exhaust control portion 169 reduces the rotating speed of the heat exhausting fans 157 and 158 as the leading edge of the sheet approaches to the delivery roller pair 124 from the fixing device 122. In addition, the heat exhaust control portion 169 is also adapted to vary the rotating speed of the heat exhausting fans in accordance with the properties and the size of the sheet.

Thus, in the copying machine 300, a sheet is not sucked to adhere to the wall 153*a* too strongly, and therefore it is possible to transport a sheet smoothly under a stable state.

In addition, in the copying machine 300, it is possible to transport a sheet along the wall 153*a* in the sheet transport path under a stable state while preventing the sheet from leaning in the right or left.

In addition to the above, the copying machine 300 according to the third embodiment has the same features as those of the copying machine 100 according to the first embodiment.

As per the above, the copying machines (i.e. image forming apparatus) 100, 200 or 300 according to any of the above-described embodiments is provided with the image forming portion (i.e. image forming means) 115 for forming a toner image on a sheet, the fixing device (i.e. fixing means) 122 for applying heat to the sheet on which the toner image has been formed by the image forming portion 115 so as to fix the toner image on the sheet, the delivery portion (i.e. delivering and stacking means) 125 on which the sheet on which the toner image has been fixed by the fixing device 122 is delivered so as to be stacked, and the heat exhausting fans (i.e. heat exhausting means) 157 and 158 provided in the vicinity of the fixing device 122 and the delivery portion 125 for exhausting air in the surroundings of the fixing device 122 and air in the surroundings of the delivery portion 125 from the right side portion (i.e. side portion) 101*b* of the main body 101 of the apparatus. In addition, there is provided the air vents 162, 163 and 168 between the fixing device 122 and the heat exhausting fans 157, 158 and between the delivery portion 125 and the heat exhausting fans 157 and 158.

With the above-described structure, since the copying machine 100, 200 or 300 is so configured that the heat generated by the fixing device 122 is exhausted immediately from the right side portion 101*b* of the main body 101 of the apparatus, the heat is not transferred to other processing units. Therefore, efficient heat exhausting can be realized and it is possible to prevent troubles such as toner blocking or fusion bond of toner from occurring. In addition, it is possible to reduce the temperature of the sheets S in the delivery portion 125 so as to prevent delivered sheet adhesion from occurring.

In the copying machine 100, 200 or 300 according to any of the above-described embodiments, the delivery portion 125 is disposed above the fixing device 122, and the sheet transport path 153 arranged in the vertical direction is provided between the fixing device 122 and the delivery portion 125, which sheet transport path 153 has air vents 164.

By virtue of this structure, the copying machine 100, 200 or 300 according to any of the above-described embodiments can transport a sheet under a stable state while causing the sheet to travel along the transport path 153 without fail. In addition, since a sheet is cooled as it travels from the fixing device 122 to the delivery portion 125 and then stacked on the delivery portion 125, it is possible to prevent delivered sheet adhesion from occurring.

The copying machine 100, 200 or 300 according to any of the above-described embodiments is provided with the heat exhaust control portion (i.e. heat exhaust control means) 169 that controls, while a sheet is transported in the sheet transport path 153, the heat exhausting fans 157 and 158 in such a way as to reduce the amount of air exhausted by the heat exhausting fans 157 and 158 as the sheet approaches from the fixing device 122 to the delivery portion 125.

With the above-described feature, the copying machine 100, 200 or 300 according to any of the above-described embodiments can vary the rotating speed of the heat exhausting fans 157 and 158 as the sheet travels through the suction area by the heat exhaust fans 157 and 158 extending from the fixing device 122 and the delivery portion 125. Therefore, excessive suction of the sheet can be prevented, and it is possible to transport the sheet stably.

In the copying machine 100, 200 or 300 according to any of the above-described embodiments, the heat exhausting fans 157 and 158 are disposed on the jammed sheet clearance door (or lid) 159 provided on the right side portion (i.e. side portion) 101*b* of the main body 101 of the apparatus.

By virtue of this structure, the copying machine 100, 200 or 300 according to any of the above-described embodiments allows easy maintenance of the heat exhaust fans 157 and 158 by detaching the jammed sheet clearance door 159 easily from the right side portion of the main body 101 of the apparatus.

In the copying machine 200 according to one of the embodiments, the jammed sheet clearance door 159 is provided on the right side portion (i.e. side portion) 101*b* of the main body 101 of the apparatus, and it is openable and closable with its rear side end being the pivot.

With this structure, in the copying machine 200 according to one of the above-described embodiments, a service person can have an access to the heat exhausting fans 157 and 158 from the front side of the main body 101 by opening the jammed sheet clearance door 159. Therefore, it is possible to reduce time required for service operations and also reduce down time of the image forming apparatus.

In the image forming apparatus according to the present invention, since heat generated by fixing means is exhausted from a side portion of the main body of the apparatus immediately, the heat is not transferred to other processing units. Therefore, it is possible to exhaust heat efficiently to prevent troubles such as toner blocking or fusion bond of toner etc.

In addition, since air in the space between fixing means and delivering and stacking means is exhausted, it is possible to cool sheets to reduce the temperature of the sheets in the delivering and stacking means. Therefore, delivered sheet adhesion can be prevented from occurring.

While the invention has been described with reference to the structure disclosed herein, the invention is not confined to the details set forth and it is intended to cover such modifications or changes as may come within the purpose of the improvements or the scope of the following claims.

The invention claimed is:

1. An image forming apparatus comprising:

a fixing device, which fixes a toner image formed on a sheet to the sheet while transporting the sheet upward;

a delivery roller, which delivers the sheet, on which the toner image is fixed by said fixing device, to a delivery space, wherein sheets delivered by said delivery roller are stacked in the delivery space;

a fan, which exhausts air in the vicinity of said fixing device and air in the delivery space to outside of a main body of said image forming apparatus;

a first air vent provided between said fixing device and said fan;

a second air vent provided in a wall of the main body;

an exhaust opening provided in the main body; and a reader unit, which reads an image of a document, wherein the wall of the main body and a lower surface of said reader unit define the delivery space, wherein said fan exhausts the air in the vicinity of said fixing device from said exhaust opening through said first air vent, and takes the air in the delivery space into the main body through said second air vent to exhaust the air in the delivery space from said exhaust opening, and wherein said fan is provided between said second air vent and said exhaust opening and on the same level as said second air vent and said exhaust opening.

2. An image forming apparatus comprising:

a fixing device, which fixes a toner image formed on a sheet to the sheet while transporting the sheet upward;

a delivery roller, which delivers the sheet, on which the toner image is fixed by said fixing device, to a delivery space, wherein sheets delivered by said delivery roller are stacked in the delivery space;

a fan, which exhausts air in the vicinity of said fixing device and air in the delivery space to outside of a main body of said image forming apparatus;

a first air vent provided between said fixing device and said fan;

a second air vent provided in a wall of the main body;

an exhaust opening provided in the main body; and a reader unit, which reads an image of a document, a guide, which guides the sheet from said fixing device to said delivery roller, wherein the wall of the main body and a lower surface of said reader unit define the delivery space, and wherein said fan exhausts the air in the vicinity of said fixing device from said exhaust opening through said first air vent, and takes the air in the delivery space into the main body through said second air vent to exhaust the air in the delivery space from said exhaust opening, and wherein said fan is provided opposite to the delivery space with said guide interposed between said fan and the delivery space.

* * * * *

UNITED STATES PATENT AND TRADEMARK OFFICE

CERTIFICATE OF CORRECTION

PATENT NO. : 7,274,892 B2
APPLICATION NO. : 11/260402
DATED : September 25, 2007
INVENTOR(S) : Tetsuro Awaya It is certified that error appears in the above-identified patent and that said Letters Patent is hereby corrected as shown below:

COLUMN 2:
Line 62, “to the” should read --the--.

COLUMN 4:
Line 13, “cross sectional” should read --cross-sectional--;
Line 16, “cross sectional” should read --cross-sectional--;
Line 24, “cross sectional” should read --cross-sectional--;
Line 27, “cross sectional” should read --cross-sectional--;
Line 31, “cross sectional” should read --cross-sectional--;
Line 33, “cross sectional” should read --cross-sectional--;
Line 35, “cross sectional” should read --cross-sectional--;
Line 37, “cross sectional” should read --cross-sectional--; and
Line 60, “cross sectional” should read --cross-sectional--.

COLUMN 6:
Line 58, “cross sectional” should read --cross-sectional--.

COLUMN 7:
Line 47, “cross sectional” should read --cross-sectional--.

COLUMN 8:
Line 14, “to” should be deleted; and
Line 29, “machines” should read --machine--.

UNITED STATES PATENT AND TRADEMARK OFFICE

CERTIFICATE OF CORRECTION

PATENT NO. : 7,274,892 B2
APPLICATION NO. : 11/260402
DATED : September 25, 2007
INVENTOR(S) : Tetsuro Awaya It is certified that error appears in the above-identified patent and that said Letters Patent is hereby corrected as shown below:

COLUMN 10:

Line 44, "and" should be deleted;
Line 45, "document" should read --documents; and--; and
Line 50, "and" should be deleted.

Signed and Sealed this

Twenty-sixth Day of August, 2008

JON W. DUDAS
*Director of the United States Patent and Trademark Office*